United States Patent [19]

Ord

[11] 4,293,967

[45] Oct. 13, 1981

[54] PIVOTAL DECK RAMP

[76] Inventor: Thomas M. Ord, Rte. 1, Box 174 D, Vaughn, Wash. 98394

[21] Appl. No.: 34,635

[22] Filed: Apr. 30, 1979

[51] Int. Cl.[3] ..... B63B 17/00

[52] U.S. Cl. ..... 9/1.6; 14/71.1; 9/1.7; 114/85

[58] Field of Search ..... 9/1.6, 1.7; 14/69.5, 14/71.1; 114/26, 70, 85, 230

[56] References Cited

U.S. PATENT DOCUMENTS

| | | | |
|---|---|---|---|
| 47,482 | 4/1865 | Wheeler | 14/71.1 |
| 3,052,896 | 9/1962 | Beach | 9/1.6 |
| 3,134,999 | 6/1964 | Reynolds | 14/71.1 |
| 4,161,795 | 7/1979 | Quest | 9/1.6 |

FOREIGN PATENT DOCUMENTS

| | | | |
|---|---|---|---|
| 1077096 | 3/1960 | Fed. Rep. of Germany | 9/1.6 |
| 1105698 | 6/1954 | France | 114/70 |
| 279355 | 11/1970 | U.S.S.R. | 14/71.1 |

*Primary Examiner*—Trygve M. Blix
*Assistant Examiner*—D. W. Keen
*Attorney, Agent, or Firm*—Kenneth S. Kessler; Roy E. Mattern

[57] ABSTRACT

A deck ramp is pivotally affixed to the bow of a boat allowing the deck ramp to serve either as a portion of the deck or as a ramp. When the deck ramp is in the closed position the deck ramp serves as a portion of the deck, which when in the open position, the deck ramp serves as a ramp for disembarkation.

10 Claims, 4 Drawing Figures

PIVOTAL DECK RAMP

BACKGROUND OF THE INVENTION

It is particularly difficult for passengers to disembark from pleasure boats such as those used for waterski boats and runabouts. Disembarkation is particularly difficult from the bow of these types of boats for many reasons among them the following: the user must climb over the windshield on most of these types of boats; the decks of the boat are usually wet and slick; and it is usually a difficult jump from the bow of the boat to the beach often resulting in a landing in shallow water rather than on solid beach.

Previous patents have addressed the problem of disembarking. In U.S. Pat. No. 3,134,999 by W. R. Reynolds a portable gang plank is disclosed. The gang plank is capable of being secured to the side of the boat whereby passengers may step off of the side of the boat onto the gang plank and on down to the beach. In contrast to the present invention, the gang plank in the Reynolds Patent is not a working part of the boat. In the present invention, a portion of the deck itself is used as a ramp. Also, the present invention allows passengers to disembark directly from the bow of the boat nullifying the necessity of disembarking from the side of the boat. When a passenger disembarks from the side of the boat, the passenger must necessarily pass over a longer stretch of water.

Two United States Patents have directed themselves to disembarking from the bow of the boat. In the J. B. Serviss U.S. Pat. No. 825,490 a swinging gang plank which disengages from the bow of the boat is disclosed. However, the swinging gang plank of the Serviss patent is an awkward extension of the bow of the boat and would pose problems to the operator of the boat when confronting waves, for the waves could easily break over the top of the swinging gang plank. As set forth previously, in the present invention, the ramp turns into a functional portion of the deck when the boat is operating and is thereby secured.

In U.S. Pat. No. 47,482 by N. W. Wheeler a gangway is described. In the Wheeler patent, as in the previous patents mentioned, the gangway is not a functional portion of the boat, the gangway in the Wheeler Patent is an addition which lies on the deck and must be pivoted in and out of position. Additionally, the gangway of the Wheeler Patent is more usefully adapted to larger size ships where extra gangways may be more easily stowed than on pleasure boats where space is at a premium.

The disclosed invention is particularly functional when used in stretches of water such as Puget Sound that must contend with tides. In these water, the users of pleasure boats typically do not dock their boats but run the boats up onto a beach with the bow of the boat barely touching the beach and the rest of the boat floating in the water. If the passengers go off the side of the boat they are certain to get wet. If they climb over windshields and over a slippery deck to the bow they face the potential of injury. Once at the bow the passenger must still jump to the beach. This is an impossibility for elderly passengers.

The option of dragging the boat on shore is also not a viable alternative. First, the hull of the boat can be damaged when drug across rocks and barnacles. Secondly, on an incoming tide, after the passengers have visited the shore, the boat will be primarily resting on water rather than beach despite the fact that it was previously drug onto the beach due to the incoming tide.

The present invention allows the passengers to merely walk to the boat of the boat, step onto a ramp and disembark.

SUMMARY OF THE INVENTION

A deck ramp is disclosed which performs two functions: in the closed position the deck ramp serves as a portion of the deck; and in its open position the deck ramp pivots to become a ramp for disembarking passengers.

The ramp is pivoted about a hinge attached to the bow of the boat. When the user brings the bow of the boat onto a beach, he merely unlatches the deck ramp that was previously serving as a portion of the deck. After the deck ramp is unlatched, the user merely pivots the deck ramp into an open position wherein the outer portion of the deck ramp rests on the beach. The user may then simply walk through the passageway created by the pivoted deck ramp in the open position; climb onto the deck ramp; and disembark from the boat.

When the user wishes to board the boat, he merely walks up the deck ramp and into the boat. Once in the boat, the user merely pivots the deck ramp into the closed position whereby it serves as a portion of the deck. The user then latches the deck ramp in place as a portion of the deck and is ready to operate the boat.

DETAILED DESCRIPTION OF THE DRAWINGS

Figure 1:
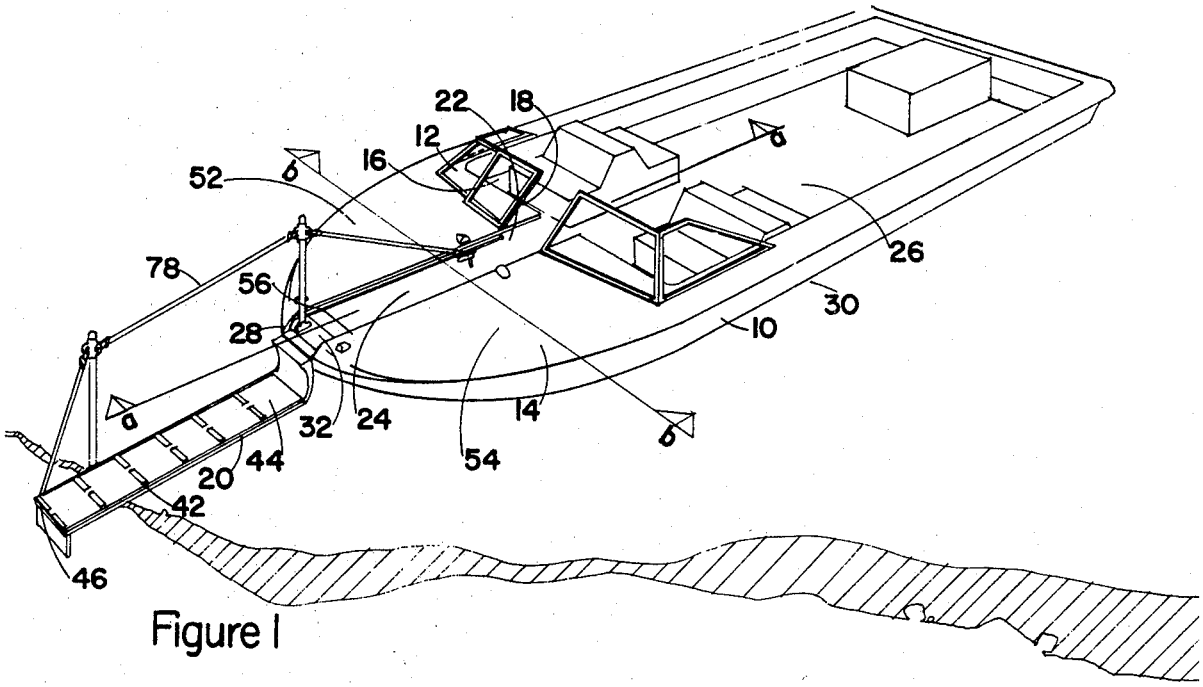
FIG. 1 is a perspective view of the deck ramp in an open position resting on a beach with the boat remaining in the water.

In FIG. 1 a pleasure boat 10 is illustrated in a perspective view. The boat 10 illustrates a low draft boat used for pleasure boating or water skiing.

A windshield 12 is secured to the deck 14 of the boat 10. In the preferred embodiment, the windshield 12 has windshield panel 16 which swings open along windshield hinge 18. The windshield panel 16 in other boats may use a sliding track rather than a swinging panel to accomplish the opening within the windshield. The width of the windshield panel 16 is slightly wider that the width of the deck ramp 20. Thus, when the windshield panel 16 is swung open the passage way 22 through the windshield 12 is at least as wide as the passageway 24 through the deck 14 created by the opened deck ramp 20.

As set forth in FIG. 1, when the deck ramp 20 is swung in the open position the passengers may walk across the boat floor 26 through the windshield passageway 22 and the deck passageway 24. Thus, the passengers need not crawl over the windshield 12 or crawl across the deck 14 to reach the front of the boat but merely walks directly to the bow 28 of the boat. When the boat floor 26 meets the hull 30, steps 32 are secured within the hull 30 at the bow 28 thereby allowing the passengers to walk up the steps 32 and step easily onto the opened deck ramp 20.

Figure 2:
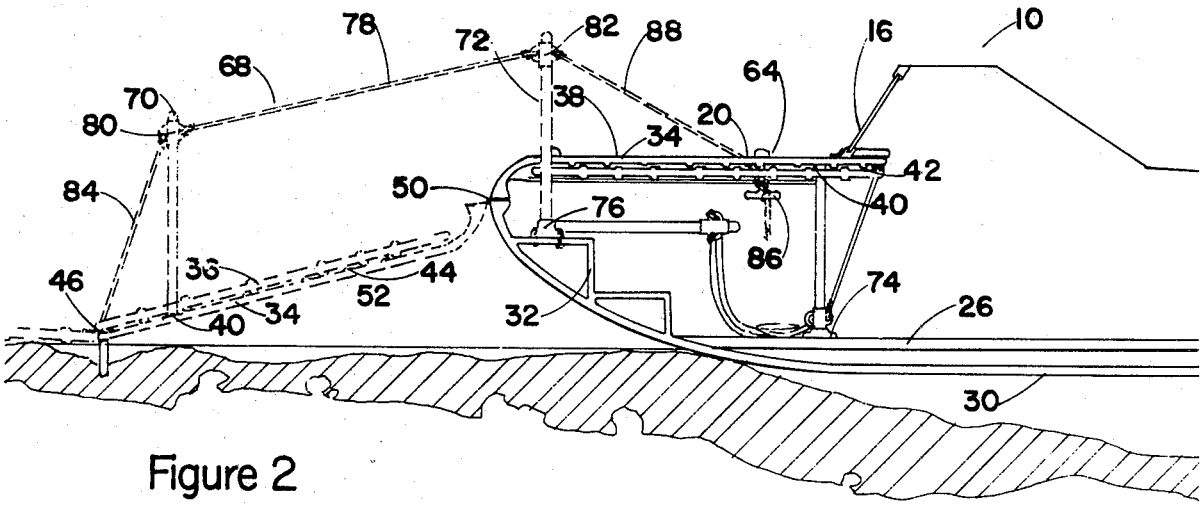
FIG. 2 is a sectional side view illustrating the deck ramp both in the open position resting on a beach and the deck ramp in the closed position thereby functioning as part of the deck.

FIG. 2 a sectional side view of the boat 10 is taken along lines 2—2 of FIG. 1 and illustrates the deck ramp 20 in both an open and closed position. The deck ramp 20 is constructed of two sections: a deck section 34 and an extension section 36. In the preferred embodiment, the deck section 34 has a deck surface 38 on one side and a non-skid surface 40 with step bars 42 on the other side. Thus, when the deck ramp 20 is closed, the deck surface 38 will be exposed thereby allowing the entire deck 14 to have one continuous surface. When the deck ramp 20 is open, the non-skid surface 40 is exposed and the departing passengers are able to walk down the non-skid surface 40 to the beach.

The extension section 36 has non-skid surfaces 44 on both sides allowing a passenger to safely walk over the extension section 36. The extension section 36 is attached to the deck section 34 of the deck ramp 20 by an extension hinge 46. As set forth in FIG. 2, the extension hinge 46 allows the extension section 36 to fold beneath the deck section 34 when the deck ramp 20 is in the closed position. When the deck ramp 20 is in the open position, the extension hinge gives the user two alternatives. First, when the beach is close as set forth in FIG. 2, the extension section 36 is kept attached. However, when the beach is a greater distance from the boat 10, the extension hinge 46 allows the extension section 36 to open from the deck section 34 thus elongating the deck ramp 20 and giving it the capability of reaching a beach at a greater distance from the boat 10 than shown in FIG. 2. The extension hinge 46 also gives the user the capability of extending the extension section 36 over potential mud on the beach.

The alternative positions of the extension section 36 illustrate the advantage of having non-skid surfaces 44 on both sides of the extension section 36. Thus, when the deck ramp 20 is open, non-skid surfaces 44 are exposed irregardless of whether the extension section 36 is attached to the deck section 34 or extended.

Figure 3:
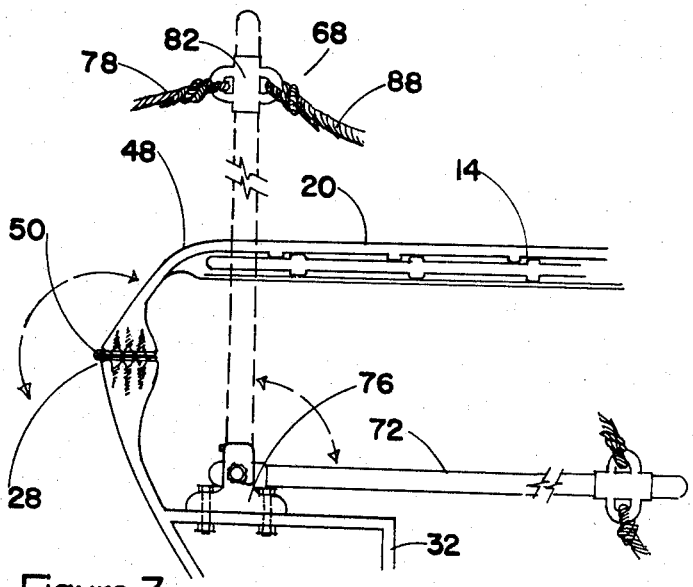
FIG. 3 is an enlarged sectional side view of the hinge which connects the deck ramp to the hull of the bow of the boat. The hinge for the railing as attached to the step is also illustrated.
Figure 4:
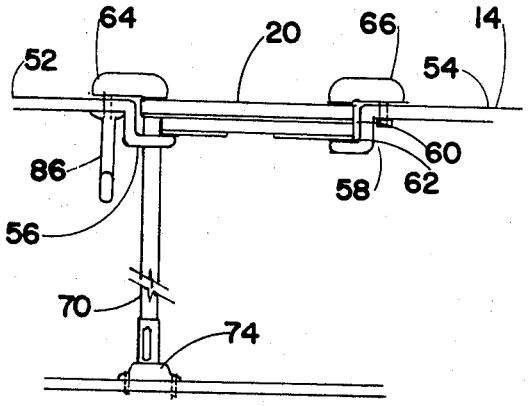
FIG. 4 is a view of the deck ramp taken along line 4—4 from within the boat looking towards the bow illustrating how the deck ramp rests on the support track and also how the deck ramp is latched into place by the swivel latches.

As illustrated in FIG. 3 the deck ramp 20 has a forward curved extension 48 which is attached to the bow 28 by deck ramp hinge 50. The forward curved extension 48 of the deck ramp 20 in the preferred embodiment is designed such that the bow 28 will be of continuous construction which is advantageous for both functional and aesthetic purposes. The deck ramp hinge 50 may be of conventional construction, its function being to open and close the deck ramp 20.

When the deck ramp 20 is open it leaves deck passageway 24 which splits the deck 14 into two deck portions 52 and 54. When the deck ramp 20 is closed it rests on support track 56 attached to deck portion 52 and support track 58 attached to deck portion 54.

Both support tracks 56 and 58 are identically constructed and run the length of the deck portions 52 to 54. Both support tracks 56 and 58 are constructed of side wall 60 which attaches to the full length of the deck portions 52 and 54 and extends at right angles for an approximate three inches beneath the deck 14. Affixed to the side wall 60 is ledge 62 which runs the length of the side wall 60. The ledge 62 is affixed at approximate right angles to the side wall 60 and, thus, approximately parallel to the deck. When the deck ramp 20 is placed in the closed position, the deck ramp 20 rests on ledges 62 and is thereby supported by support tracks 56 and 58.

Once the deck ramp 20 rests against the support tracks 56 and 58, the deck ramp 20 is secured to the deck 14 by swivel latches 64 and 66.

Swivel latch 64 is attached to deck portion 52 and swivellatch 66 is attached to deck portion 54. When the user wishes to open the deck ramp 20, the swivel latches 64 and 66 are pivoted away from the deck ramp 20. When the swivel latches 64 and 66 are opened, the user is free to swing the deck ramp 20 open for there is nothing further to restrict the motion of the opening deck ramp 20. To secure the deck ramp 20 when the deck ramp 20 is closed, the user merely pivots the swivel latches 64 and 66 over the deck ramp 20 thus holding the deck ramp 20 secure.

A collapsible railing 68 is designed to work in conjunction with the deck ramp 20. The collapsible railing 68 is constructed of rails 70 and 72. Rail 70 is permanently affixed to the non-skid surface 40 of the deck section 36 of the deck ramp 20. When the collapsible railing 68 is used, the extension section 36 of the deck ramp 20 is narrower than the deck section 34 thereby allowing rail 70 to be affixed directly to deck section 34. When the deck ramp 20 is in the closed position, rail 70 extends vertically towards the boat floor 26 where it is held in position by rail holder 74. When the deck ramp 20 is in the open position, the rail 70 rises vertically from the deck section 34.

Affixed to steps 32 is rail hinge 76. Affixed to rail hinge 76 is rail 72. When the deck ramp 20 is in the closed position, the rail 72 is swung beneath the deck 14. When the deck ramp 20 is opened the rail 72 is swung up to a position at approximate right angles to the steps 32.

Strung between rails 70 and 72 is line 78. When the deck ramp 20 is swung open, the line 78 becomes taut and as the deck ramp 20 continues its swing, the rail 72 is pulled by line 78 into its vertical position. Line 78 also functions as a hand rail as passengers depart the boat 10. Line 78 is secured to double eye tie downs 80 and 82 affixed to rails 70 and 72 respectively.

Line 84 is strung between rail 70 and deck section 34 and serves to add support strength in the holding of the rail 70 in position.

Strung between rail 72 and cleat 86 is line 88. Cleat 86 is affixed beneath deck portion 52 and is, thus, permanently beneath the deck 14. The line 88 prevents the rail 72 from swinging beyond a given position which is approximately at right angles with the deck 14. The line 88 also functions as a hand rail as passengers climb the steps 32 departing from the boat 10.

Although a particular preferred embodiment of the invention has been disclosed above for illustrative purposes, it will be understood that variations or modifications thereof which lie within the scope of the appended claims are contemplated.

I claim:

1. A deck ramp for the disembarking of passengers from boats comprising:

a first ramp section;

a means of attaching the ramp to a boat whereby the first ramp may be pivoted about the means of attachment;

a second ramp section;

a hinge which attaches the second ramp section to the first ramp section wherein when the first ramp section is placed in the closed position, the second ramp section is capable of positioning itself beneath the first ramp section, and when the first ramp section is in the open position, the second ramp is capable of pivoting as an extension of the first ramp section.

a first rail affixed to the first ramp section;

a hinge affixed to the inner hull of the boat;

a second rail affixed to the hinge; and a line affixed to the first rail and affixed to the second rail such that when the deck ramp is placed in the open position the line pivots the second rail about the hinge affixed to the boat to an approximate vertical position.

2. The deck ramp of claim 1 wherein the ramp is also capable of serving as a portion of the deck of a boat.

3. The deck ramp of claim 2 wherein the means of attaching the ramp to a boat comprises a hinge.

4. The deck ramp of claim 1 wherein the means of attaching the deck ramp to the boat is positioned in the bow of the boat where the sides of the boat meet the deck.

5. The deck ramp of claim 4 wherein the deck ramp is secured to a boat with a deck wherein the deck ramp when in the closed position forms a portion of the deck and steps are secured withing the hold of the boat at the bow as an approach to the deck ramp when extended.

6. The deck ramp of claim 1 wherein the first and second ramp sections are also capable of serving as a portion of the deck of a boat.

7. The deck ramp of claim 1 wherein the means of attaching the ramp to a boat comprises a hinge.

8. A boat capable of allowing passengers to disembark from the bow of the boat comprising:

a boat;

a first ramp section;

a means of attaching the ramp to a boat whereby the first ramp may be pivoted about the means of attachment;

a second ramp section;

a hinge which attaches the second ramp section to the first ramp section wherein when the first ramp section is placed in a closed position, the second ramp section is capable of positioning itself beneath the first ramp section, and when the first ramp section is in the open position, the second ramp section is capable of pivoting as an extension of the first ramp section;

a first rail affixed to the first ramp section;

a hinge affixed to the inner hull of the boat;

a second rail affixed to the hinge; and a line affixed to the first rail and affixed to the second rail such that when the deck ramp is placed in the open position the line pivots the second rail about the hinge affixed to the boat to an approximate vertical position.

9. The boat capable of allowing passengers to disembark from the bow of the boat of claim 8 wherein the first and second ramp sections are also capable of serving as a portion of the deck of the boat.

10. The boat capable of allowing passengers to disembark from the bow of the boat of claim 8 wherein the means of attaching the ramp to a boat comprises a hinge.

* * * * *